US006166610A

United States Patent [19]

Ramanujam et al.

[11] Patent Number: 6,166,610

[45] Date of Patent: Dec. 26, 2000

[54] INTEGRATED RECONFIGURABLE POLARIZER

[75] Inventors: Parthasarathy Ramanujam, Redondo Beach; Alan R. Keith, Fullerton, both of Calif.

[73] Assignee: Hughes Electronics Corporation, El Segundo, Calif.

[21] Appl. No.: 09/255,122

[22] Filed: Feb. 22, 1999

[51] Int. Cl.[7] ..... H01P 1/165

[52] U.S. Cl. ..... 333/21 A; 333/161

[58] Field of Search ..... 333/21 A, 157, 333/125, 137

[56] References Cited

U.S. PATENT DOCUMENTS

| | | | |
|---|---|---|---|
| 2,438,119 | 3/1948 | Fox | 333/157 X |
| 2,607,849 | 8/1952 | Purcell et al. | 333/21 A |
| 3,166,724 | 1/1965 | Allen | 333/157 X |
| 3,626,335 | 12/1971 | Hord et al. | 333/21 A X |
| 4,672,334 | 6/1987 | Saad | 333/157 X |

FOREIGN PATENT DOCUMENTS

| | | | |
|---|---|---|---|
| 260901 | 10/1990 | Japan | 333/21 A |

*Primary Examiner*—Benny Lee
*Attorney, Agent, or Firm*—Terje Gudmestad

[57] ABSTRACT

A tunable polarizer having a 90 degree phase shift section and two adjustable, or rotatable, 45 degree phase shift sections. Each section is separated by spacer to maintain independence and avoid interaction. When the two 45 degree phase shift sections and are orthogonal to each other, the polarization detected is determined by the 90 degree phase shift section which provides compatibility with circularly polarized signal. When the two 45 degree phase shift sections and are aligned, the polarizer is in a linear polarization compatibility mode.

20 Claims, 2 Drawing Sheets

| Desired Polarization | 90° Element | Orientation of First 45 Deg. Element | Orientation of Second 45 Deg. Element |
|---|---|---|---|
| Vertical or Horizontal Linear | Fixed | 45 Deg. | 45 Deg. |
| Rotated Linear | Fixed | 45 Deg. to Required Direction | 45 Deg. to Required Direction |
| Circular | Fixed | Any Angle ($\alpha$) | $\alpha$ + 90 Degrees |

INTEGRATED RECONFIGURABLE POLARIZER

TECHNICAL FIELD

The present invention relates to polarization of antennas, and more particularly, to a reconfigurable polarizer.

BACKGROUND ART

Typically, satellite antennas operate in either linear or circular polarizations. Therefore, antennas are designed to have either linear or circular polarization. In some instances during orbit it is desirable to switch the polarization of a satellite's antenna from linear to circular or vice versa.

For antennas operating with linear polarizations, the orientation of the polarization is fixed before the satellite is launched. The fixed linear polarization is a problem in situations where it becomes necessary to modify the orientation of the linear polarization while the satellite is in orbit. For example, when a satellite is moved from one orbit slot to another, its orientation to ground is changed. Another example, is when a user of a particular satellite is changed.

In the prior art complex methods are known that allow arbitrary polarization. One method is to separate a signal into two orthogonal polarizations. The two components are used directly for linear polarization. However, the antenna feed must be properly oriented to the desired polarization.

Reorientation of the linear polarization is accomplished by using two 90° polarizers back-to-back. A polarizer is located near an ortho-mode transducer that converts circular polarization to linear polarization, or linear to circular depending on whether it is used in receive mode or transmit mode. A second polarizer is located near the antenna feed and is oriented to provide the proper linear polarization orientation upon output of the signal, or to generate circular polarization upon receiving a particular linear polarization.

When converting linear polarization to circular polarization, the linear signal must be decomposed into two orthogonal components that are then recombined with a 90 degree phase shift in one of the components. To select whether linear or circular polarization is to be used, a separate path is chosen to process the signal and achieve the desired polarization.

An alternative approach includes two feeds for one antenna. One feed is for linear polarization and the other feed is for circular polarization. The circular polarization feed must be integrated with a polarizer. The appropriate feed is chosen depending on the desired polarization.

A problem with both of the methods described above is that a switching method is required. The need for separate feeds requires switching between feeds in order to select the polarization. Likewise it is necessary to have switchable paths with the decomposition of the signal into two orthogonal components.

SUMMARY OF THE INVENTION

The present invention is a reconfigurable polarizer for an antenna that uses a single feed to receive or transmit any polarization and orientation. The present invention eliminates the need for separate feeds or switchable paths. The present invention can be applied to all antennas where a reconfigurable polarization is needed. For example, single or dual reflectors that are fed by a single feed or a feed array, and can operate in linear and circular polarized modes of operation. The present invention can also be applied to a direct radiating array.

The present invention is a tunable polarizer having three sections; one 90 degree phase shift section and two adjustable 45 degree sections. The orientation of the 45 degree sections with respect to each other allow the 90 degree phase shift section to detect the circular polarization, convert a linear signal to circular polarization or convert a circular signal to linear polarization. The three sections are separate and do not interact with each other. In order to remain independent, spacers are located between sections to insure against interaction.

It is an object of the present invention to use a single feed to receive or transmit any polarization and orientation. It is another object of the present invention to alter the orientation of a linear polarization. It is still another object of the present invention to switch the polarization from linear to circular polarization.

It is a further object of the present invention to reconfigure the polarization of an antenna. It is still a further object of the present invention to reconfigure the polarization of an antenna for a satellite while the satellite is in orbit.

Other objects and features of the present invention will become apparent when viewed in light of the detailed description of the preferred embodiment when taken in conjunction with the attached drawings and appended claims.

BEST MODE(S) FOR CARRYING OUT THE INVENTION

Figure 1:
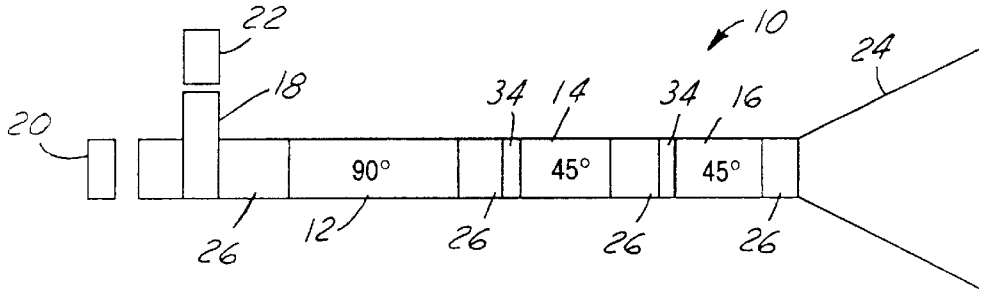
FIG. 1 is a block diagram of the tunable polarizer of the present invention.
Figures 4, 5:
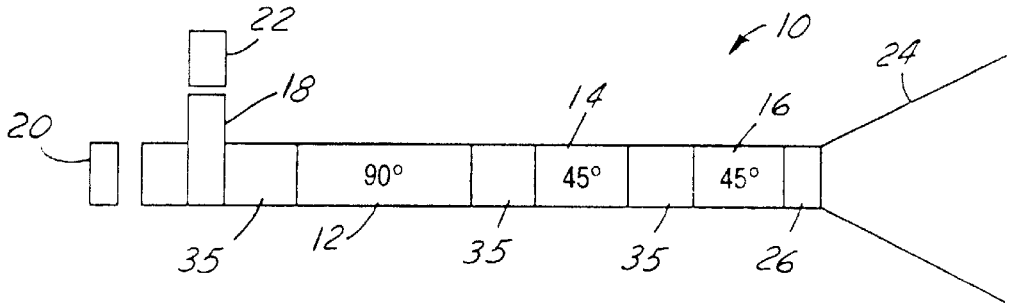
FIG. 4 is a block diagram of the tunable polarizer of the present invention having an adjustable 90 degree phase shift section and spacers combined with rotary joints.
FIG. 5 is a table outlining three polarizations and the respective orientations of the phase shift sections.

The present invention is a tunable, or adjustable polarizer 10 as shown in FIGS. 1 and 4. The polarizer 10 is divided into three sections, a 90 degree phase shift section 12, a first adjustable 45 degree phase shift section 14 and a second adjustable 45 degree phase shift section 16. The degrees of the phase shift sections correspond to the amount of phase shift between two orthogonal linearly polarized components.

The polarizer 10 has an ortho-mode transducer 18, a through port 20 and an orthogonal port 22 at one end and an antenna feed 24 at the opposite end. The antenna feed 24 should support two orthogonal polarizations. The ortho-mode transducer 18 will propagate orthogonal the transmit and receive modes.

The 90 degree phase shift section is located adjacent to the ortho-mode transducer 18, followed by the first 45 degree phase shift section, the second 45 degree phase shift section, and the antenna feed 24.

Sufficient space must be left in between the phase shift sections 12, 14, and 16 to avoid interaction between sections. The spacers 26 ensure that each of the three sections is separated from the others. Each spacer 26 is a simple waveguide, typically a circular waveguide. Spacers 26 are located between the 90 degree phase shift section 12 and the first 45 degree phase shift section 14 and between the first and second 45 degree phase shift sections 14 and 16. Spacers 26 are also located between the ortho-mode transducer and the 90 degree phase shift section 12 and between the second 45 degree phase shift section 16 and the feed 24.

Figure 2:
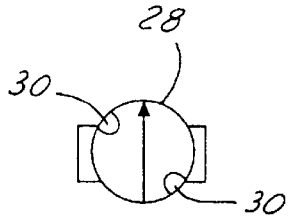
FIG. 2 is a cross-sectional view of a typical polarizer used for the phase shift sections.

The phase shift sections 12, 14 and 16 are polarizers 28 (see FIG. 2). FIG. 2 is a cross sectional view of an exemplary polarizers. The polarizer 28 has polarizing elements 30. In the present example the polarizing elements are pins, but one skilled in the art would know that the type of polarizer is not important to the success of the present invention and that a variety of polarizing elements 30 may be substituted to accomplish similar results.

The 90 degree phase shift section 12 is fixed in its orientation with respect to the direction of incident polarization 32 (see FIG. 3) and introduces a phase shift of 90 degrees. The adjustable 45 degree phase shift sections 14 and 16 introduce a phase shift of 45 degrees. The first and second 45 degree phase shift sections 14 and 16 are rotatable to alter the polarization properties.

Figure 1A:
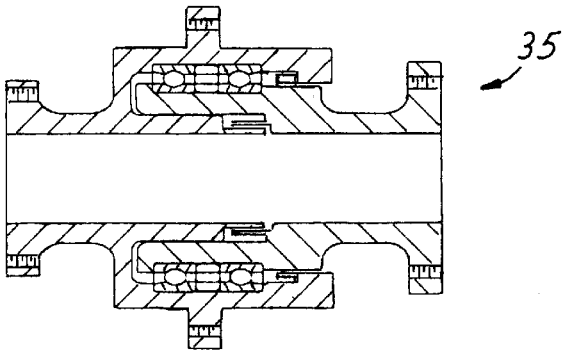

The rotations of the first and second adjustable 45 degree phase shift sections 14 and 16 may be made using standard rotary joints 34 as shown in block form in FIG. 1. It is possible to combine the spacer 26 and the rotary joint 34 into one unit 35 (shown in FIG. 4). In the case of a combined spacer and rotary joint, the rotary joint must be sufficiently long enough to isolate the phase shift sections. An example of such a rotary joint 35 is shown in FIG. 1A. However, it should be noted that while one specific example is shown, there are several types of rotary joints that one skilled in the art is capable of substituting for the style shown in FIG. 1A.

The polarizer 10 of the present invention can be used in both transmit and receive modes. The invention will be described herein in the transmit mode when a vertical signal is input at one port of the ortho-mode transducer 18. Transmit mode is when a signal, either circular or linear, is received at the ortho-mode transducer 18 and output at the antenna feed 24. One skilled in the art will know how to apply the description of the present invention for the receive mode.

Figure 3:
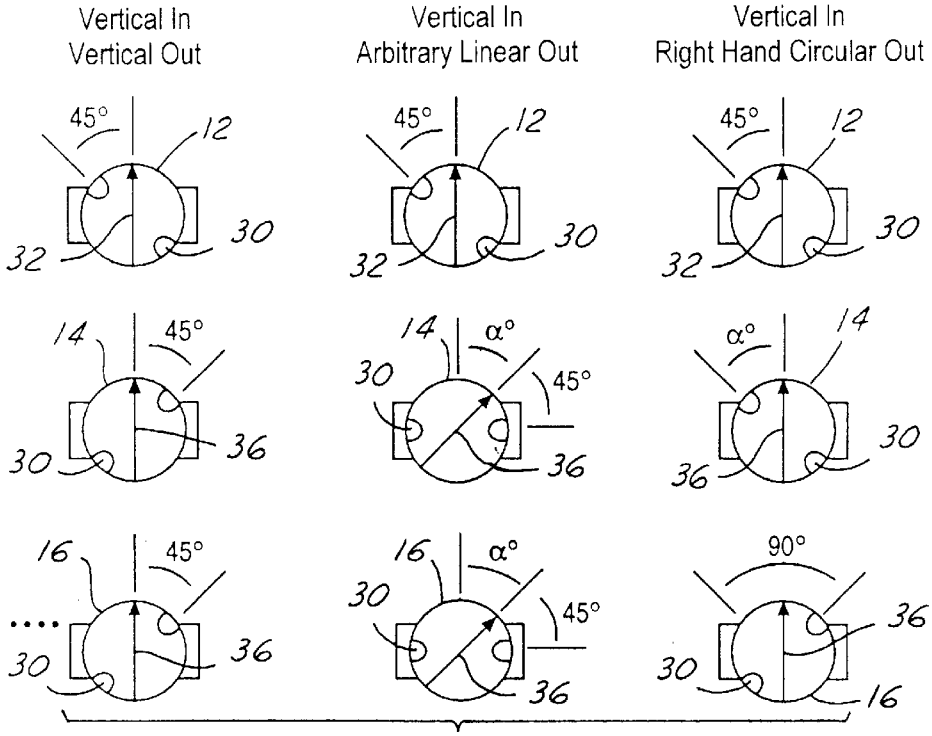
FIG. 3 is a diagram of the polarizer orientations for three polarizations.

For linear polarization compatibility, shown in the first two columns of FIG. 3, the polarizing elements 30 of the two adjustable 45 degree phase shift sections 14 and 16 are aligned with each other. The orientation of the linear signal at the output of the second 45 degree polarizer 16 is the desired polarization direction 36. This polarization direction 36 is at an arbitrary angle, $\alpha$, from the direction of incident polarization 32, (which is vertical in the present example), at the ortho-mode transducer 18. This is illustrated in the second column of FIG. 3. Vertical polarization is illustrated in the first column of FIG. 3. For vertical polarization a $\alpha=0$ degrees. For any linear polarization direction, the polarizing elements 30 of the first and second 45 degree phase shift sections are at a 45 degree angle with respect to the desired polarization direction 36.

For circular polarization compatibility, shown in the third column of FIG. 3, the polarizing elements 30 of the two adjustable 45 degree phase shift sections 14 and 16 are rotated orthogonal to each other such that their net effect is a zero degree phase shift. The polarization is then determined by the 90 degree phase shift section 12 which provides compatibility with circularly polarized signals.

The alignment of the first and second 45 degree phase shift sections 14 and 16 relative to the 90 degree phase shift section 12 is entirely arbitrary. As long as the first and second 45 degree phase shift sections 14 and 16 are orthogonal to each other, (as indicated by the 90° symbol shown in the third column of FIG. 3), they can be oriented in any direction with respect to the 90 degree phase shift section 12. Depending on the desired circular polarization, right hand circular or left hand circular, the polarizing elements 30 of the 90 degree phase shift section are oriented to either be plus or minus 45 degrees from the direction of incident polarization 32 which is vertical in the present example.

In operation, a linear signal received at the antenna feed 24 and passing through the first and second 45 degree phase shift sections 14 and 16 will be converted to circular polarization. The 90 degree phase shift section 12 then converts this polarization to a linear polarization that is oriented to a predetermined port on the ortho-mode transducer 18. The predetermined port can be either the through port 20, the orthogonal port 22.

Referring again to FIG. 3, the orientations of the phase shift sections are described in detail for three possible polarizations. The 90 degree phase shift section 12 has polarizing elements 30 that are always in a ±45 degree orientation with respect to the incident polarization direction 32.

For vertical polarization transmitting out the through port, the orientation of the 90 degree phase shift section 12 has the polarizing elements 30 oriented 45 degrees to the direction of the incident polarization 32. The first and second 45 degree phase shift sections 14 and 16 are aligned with each other and the polarizing elements 30 are positioned 45 degrees with respect to the desired polarization direction 36. In the present example, vertical polarization is transmitted out the through port 20 and horizontal polarization is transmitted out the orthogonal port 22 of the ortho-mode transducer 18.

For arbitrary linear polarization, the 90 degree phase shift section 12 remains fixed. The first and second 45 degree phase shift sections 14 and 16 remain aligned with each other and the polarizing elements 30 remain oriented 45 degrees from the desired polarization direction 36. However, the desired polarization direction 36 is oriented at an angle, $\alpha$, from the incident polarization 32 of the 90 degree phase shift section 12. In the present example, arbitrary linear polarization is transmitted out the through port 20 and orthogonal arbitrary linear polarization is transmitted through the orthogonal port 22.

For right hand circular polarization, the 90 degree phase shift section 12 remains fixed. The first 45 degree phase shift section 14 is set to any arbitrary angle, $\alpha$ relative to the direction of incident polarization 32. The second 45 degree phase shift section 16 is oriented such that the polarizing elements 30 are orthogonal to the polarizing elements 30 of the first 45 degree phase shift section 14. In the present example, the linear signal corresponding to right hand circular polarization is transmitted through the through port 20 and the linear signal corresponding to left hand circular polarization is transmitted through the orthogonal port 22.

It is possible to implement an adjustable 90 degree phase shift section 12 as well. Referring to FIG. 4 the polarizer 10 of the present invention is shown with a combination spacer/rotary joint 35 at the 90 degree phase shift section 12. This reverses the polarization associated with the through and orthogonal ports. For example, in the vertical polarization example described above, the 90 degree phase shift section may be rotated 90 degrees and the vertical polarization will be associated with the orthogonal port 22 while the horizontal polarization will be associated with the through port 20. Typically, spacecraft communication channels have specific bands associated with vertical and horizontal polarizations. The adjustable 90 degree phase shift section is useful in spacecraft applications that require channel switching between the through port 20 and the orthogonal port 22.

FIG. 5 is a table identified in FIG. 5 by reference number 38 outlining the configuration of the polarizer for three polarization scenarios. For any polarization scenario the polarizing elements 30 of the 90 degree phase shift section 12 remain fixed. The polarizing elements 30 of the first and second 45 degree phase shift sections 14 and 16 are adjusted according to the desired polarization.

For horizontal and vertical polarization the polarizing elements 30 of the first and second 45 degree phase shift sections 14 and 16 are at 45 degrees to the incident polarization direction. For rotated linear polarization, the polarizing elements 30 of the first and second 45 degree phase shift sections 14 and 16 are at 45 degrees to the desired direction. For circular polarization, the polarizing elements 30 of the first 45 degree section 14 is set at any angle, $\alpha$, while the polarizing elements 30 of the second 45 degree section 16 are set to $\alpha$+90 degrees.

The polarizer 10 of the present invention is capable of receiving a signal and transmitting circular, linear polarization, or a linear polarization of arbitrary orientation. This allows a single feed to receive or transmit any polarization and orientation. The polarization of a satellite's antenna may be switched from linear to circular while in orbit by repositioning the first and second adjustable 45 degree phase shift sections 14 and 16. For linear polarization, the orientation of the linear signal may be modified while a satellite is in orbit. The present invention does not require separate feeds or switchable paths to accomplish a reconfigurable polarization.

While particular embodiments of the invention have been shown and described, numerous variations and alternate embodiments will occur to those skilled in the art. Accordingly, it is intended that the invention be limited only in terms of the appended claims.

What is claimed is:

1. A polarizer having first and second ends, said first end having an ortho-mode transducer having a through port and an orthogonal port, said second end having a feed, said polarizer comprising:

a 90 degree polarizer spaced a distance from said ortho-mode transducer, said 90 degree polarizer having a predetermined incident polarization direction;

a first adjustable 45 degree polarizer spaced a distance from said 90 degree polarizer, said first adjustable 45 degree polarizer having a first adjustable desired polarization direction;

a second adjustable 45 degree polarizer spaced a distance from said first 45 degree polarizer, said second adjustable 45 degree polarizer having a second adjustable desired polarization direction;

a plurality of spacers located between at least two of said polarizers; and said first and second adjustable 45 degree polarizers are aligned for a linear polarization and said first and second adjustable 45 degree polarizers are orthogonal to each other for circular polarization.

2. The polarizer as claimed in claim 1 wherein said plurality of spacers are respective circular waveguides.

3. The polarizer as claimed in claim 1 wherein said first and second adjustable 45 degree polarizers comprise respective adjustable rotary joints.

4. The polarizer as claimed in claim 3 wherein said respective rotary joints and corresponding said spacers are combined into a respective common unit.

5. The polarizer as claimed in claim 1 wherein said 90 degree polarizer is rotatable.

6. The polarizer as claimed in claim 5 wherein said 90 degree polarizer is comprised of a rotary joint.

7. The polarizer as claimed in claim 6 wherein said rotary joint and said spacers are combined into a respective common unit.

8. The polarizer as claimed in claim 1 wherein said first and second adjustable 45 degree polarizers are aligned with each other and rotated a predetermined angle from said incident polarization direction for arbitrary linear polarization.

9. The polarizer as claimed in claim 1 wherein said 90 degree and said first and second adjustable 45 degree polarizers have polarizing elements that are pins.

10. The polarizer as claimed in claim 1 wherein said first and second adjustable desired polarization directions of said first and second adjustable 45 degree polarizers are aligned with said incident polarization direction of said 90 degree polarizer to provide for vertical polarization at said ortho-mode transducer.

11. A polarizer comprising:

an ortho-mode transducer having a through port and an orthogonal port;

a first space adjacent said ortho-mode transducer;

a 90 degree polarizer adjacent said first spacer;

a second spacer adjacent said 90 degree polarizer;

a first adjustable 45 degree polarizer adjacent said second spacer;

a third spacer adjacent said first adjustable 45 degree polarizer;

a second adjustable 45 degree polarizer adjacent said third spacer;

a fourth spacer adjacent said second adjustable 45 degree polarizer; and a feed adjacent said fourth spacer.

12. The polarizer as claimed in claim 11 wherein said first adjustable 45 degree polarizer is orthogonal to said second adjustable 45 degree polarizer for circular polarization and their relative alignment to said 90 degree polarizer is arbitrary.

13. The polarizer as claimed in claim 11 wherein said 90 degree polarizer is either in a positive or negative 45 degree orientation with respect to said ortho-mode transducer.

14. The polarizer as claimed in claim 11 wherein said first adjustable 45 degree polarizer is aligned with said second adjustable 45 degree polarizer for linear polarization.

15. The polarizer as claimed in claim 14 wherein said 90 degree polarizer has a direction of incident polarization and said first and second adjustable 45 degree polarizers are oriented to be a respective predetermined angle from said direction of incident polarization for arbitrary linear polarization.

16. The polarizer as claimed in claim 11 wherein said first and second adjustable 45 degree polarizers respectively comprised of at least one rotary joint.

17. The polarizer as claimed in claim 16 wherein said second spacer is combined with one of said at least one rotary joints and said third spacer is combined with another of said at least one rotary joints, respectively.

18. The polarizer as claimed in claim 11 wherein said 90 degree polarizer is adjustable.

19. The polarizer as claimed in claim 18 wherein said adjustable 90 degree polarizer is comprised of a rotary joint.

20. The polarizer as claimed in claim 19 wherein said rotary joint and said first spacer are combined into a respective common unit.

* * * * *